US007160203B2

(12) United States Patent
Bonneau

(10) Patent No.: US 7,160,203 B2
(45) **Date of Patent: *Jan. 9, 2007**

(54) REAR, PERIMETER, AND FACE WEIGHTED PUTTER SUPPORT

(76) Inventor: Michael D. Bonneau, 5831 Algonquin Way, San Jose, CA (US) 95138

( * ) Notice: Subject to any disclaimer, the term of this patent is extended or adjusted under 35 U.S.C. 154(b) by 280 days.

This patent is subject to a terminal disclaimer.

(21) Appl. No.: 10/826,184

(22) Filed: Apr. 15, 2004

(65) Prior Publication Data

US 2005/0233828 A1 Oct. 20, 2005

(51) Int. Cl.
*A63B 53/04* (2006.01)
*A63B 53/06* (2006.01)

(52) U.S. Cl. ..... 473/334; 473/340; 473/341; 473/349

(58) Field of Classification Search ..... 473/334–339, 473/340–341, 288, 349, 324–329, 350, 290–291, 473/244–256, 345; D21/736–746
See application file for complete search history.

(56) References Cited

U.S. PATENT DOCUMENTS 1,666,174 A * 4/1928 Holland ..... 473/251
RE19,178 E * 5/1934 Spiker ..... 473/251
3,143,349 A * 8/1964 MacIntyre ..... 473/338
4,121,832 A 10/1978 Ebbing
4,194,739 A 3/1980 Thompson
5,211,401 A 5/1993 Hainey
5,489,097 A 2/1996 Simmons
5,676,606 A 10/1997 Schaeffer et al.
5,769,738 A * 6/1998 Kershaw et al. ..... 473/340
5,782,706 A 7/1998 DePriest
5,797,176 A 8/1998 Rose et al.
5,803,825 A * 9/1998 Hamilton ..... 473/252
5,839,974 A 11/1998 McAllister
5,842,935 A 12/1998 Nelson
5,871,407 A 2/1999 Tseng
5,951,412 A 9/1999 Rose et al.
5,971,867 A 10/1999 Galy
6,017,280 A 1/2000 Hubert
6,019,686 A 2/2000 Gray
6,080,068 A 6/2000 Takeda
6,123,627 A 9/2000 Antonious
6,149,534 A 11/2000 Peters et al.
6,267,689 B1 7/2001 Ambrose
6,270,423 B1 8/2001 Webb
6,315,678 B1 11/2001 Teramoto
6,336,869 B1 1/2002 Hettinger et al.
6,386,990 B1 5/2002 Reyes et al.
6,409,612 B1 6/2002 Evans et al.
6,450,897 B1 9/2002 Stites et al.
6,471,600 B1 * 10/2002 Tang et al. ..... 473/242
6,485,375 B1 11/2002 McKinley
6,607,452 B1 8/2003 Helmstetter et al.
6,783,466 B1 8/2004 Seki et al.
6,796,911 B1 * 9/2004 Grace ..... 473/251

* cited by examiner

*Primary Examiner*—Sebastiano Passaniti
(74) *Attorney, Agent, or Firm*—Schneck & Schneck

(57) ABSTRACT

A golf putter head has a main body frame that is rear, perimeter and face weighted. A first weighting member weights the main body frame in the front and a second weighting member weights the rear and perimeter of the main body frame providing a dynamically balanced putter. The main body frame has a front region and a top surface with an underside in an upper portion of the main body frame. The first weighting member is attached to the front of the main body frame, and the second weighting member is attached to the underside of the main body frame. The main body frame supports various combinations of first and second weighting member weights and main body weights to achieve a dynamically balanced putter.

56 Claims, 6 Drawing Sheets

REAR, PERIMETER, AND FACE WEIGHTED PUTTER SUPPORT

FIELD OF THE INVENTION

The invention relates to putters in general, and, in particular, to weighted putter heads.

BACKGROUND OF THE INVENTION

Various types of golf clubs have been developed to assist golfers in improving their golfing skills. In particular, golf putters have been designed in the past with embedded weights in the club head to assist a golfer in improving his putting skills. Balancing the putter head is important so that one can consistently address and stroke the ball properly to make straight putts. A putter that is balanced will usually give the "best feel" and yield the greatest accuracy.

For instance, U.S. Pat. No. 6,485,375 to McKinley discloses a high center of gravity modular putter having interchangeable weight inserts along the side of the putter, rails that run longitudinally from the rear to the front of the putter head, and an insert face block having a softer or harder compound and a cavity.

U.S. Pat. No. 5,676,606 to Schaeffer et al. discloses a putter head with an arcuate weight heavier than the material of the rest of the club. The weighting member is positioned to provide a low center of gravity.

U.S. Pat. No. 5,839,974 to McAllister discloses weighted inserts for a putter face plate that will bias the putter into a "closed face" or "open face" alignment.

U.S. Pat. No. 6,270,423 to Webb discloses a putter having a front face formed with a depression in order to insertably receive one of the selected cartridges within which a pad, selected from a group of pads having different densities is selected.

Although there are a wide variety of putters available to golfers, golfers still seek improved designs that will assist them in yielding the greatest accuracy during putting.

Therefore, it is an object of the present invention to provide a new and improved putter head.

A further object of the present invention is to provide a putter head which has a high center of gravity.

It is an additional object of the present invention to provide a putter head that is dynamically balanced.

It is another object of the present invention to provide a new and improved putter.

SUMMARY OF THE INVENTION

The above and other objects have been achieved with a putter head including a main body frame that is rear, perimeter and face weighted. The main body frame forms a support structure for added weighted portions. The main body frame has a front portion, a top surface with an underside in an upper portion of the main body frame. A first weighting member is attached to the front of the main body frame, and a second weighting is member is attached to the underside. The first weighting member provides additional weight in a front portion of the putter head and the second weighting member provides additional rear and side weight in an upper portion of the putter head, resulting in a dynamically balanced putter.

To achieve a dynamically balanced putter, various combinations of first and second weighting member weights and main body weights are used. For example, it is desired that either the first weighting member and the second weighting member or the first weighting member and the main body have the same weight to achieve a dynamically balanced putter. In one example, any two of the group consisting of a first weighting member weight, a second weighting member weight, and a main body weight are the same weight. In one example, the first weighting member and second weighting member each weigh more than the main body. In another example, the first and second weighting members each weigh less than the main body. In an additional example, the first weighting member and the main body weigh more than the second weighting member. In another example, the first weighting member and the main body each weigh less than the second weighting member.

To achieve the various weight combinations the first weighting member, the second weighting member and the main body frame are comprised of various materials. For example, the main body is comprised of a first material having a first density and the first and second weighting members are comprised of a different material having a different density, with respect to the first material density. In one example, the different material has a density greater than the density of the first material.

Various materials may be utilized in the present invention. For example, the main body frame is comprised of aluminum while the first and second weighting members are comprised of a material selected from the group consisting of brass, tungsten, stainless steel, and iron.

Additionally, the main body frame further includes a sole opposed to the top surface, a perimeter defining side and rear surfaces of the main body, and a front surface disposed between the side surfaces. The top surface and the underside extend outwardly to the perimeter surfaces.

Any type of putter, such as for example, a mallet style putter or a blade putter may include the putter head of the present invention. The putter head is modular in design. Additionally, any putter may be altered to include the main body frame of the present invention. Specifically, when altering a putter head, an upper portion of the putter head is milled out to receive a weighting member and a front portion of the putter head is milled out to receive another weighting member.

The putter head of the present invention has a high center of gravity. This is due, at least in part, to the placement of the weighted member in an upper portion of the putter head. Additionally, the main body of the putter may itself have a high center of gravity. Where the main body frame of a prior art putter lacks a high center of gravity, the main body is milled out and one or more of the weighting members attached to the body provide the main body and the putter head with a high center of gravity.

The putter head of the present invention is advantageous in at least that it recognizes the importance of a relationship between a first weighting member, a second weighting member, and the main body and uses that relationship to achieve a dynamically balanced putter. Further, it provides a main body frame that forms a support structure for the weighted portions. A dynamically balanced putter results in less torquing of the club. Thus, the putter of the present invention "feels good" to a golfer. This allows a golfer to consistently address and stroke the ball properly to make straight putts, yielding a good accuracy. Upon striking a ball with a putter incorporating the putter head of the present invention, the ball achieves an immediate forward roll which is desirable when putting.

DETAILED DESCRIPTION OF THE INVENTION

Figure 1:
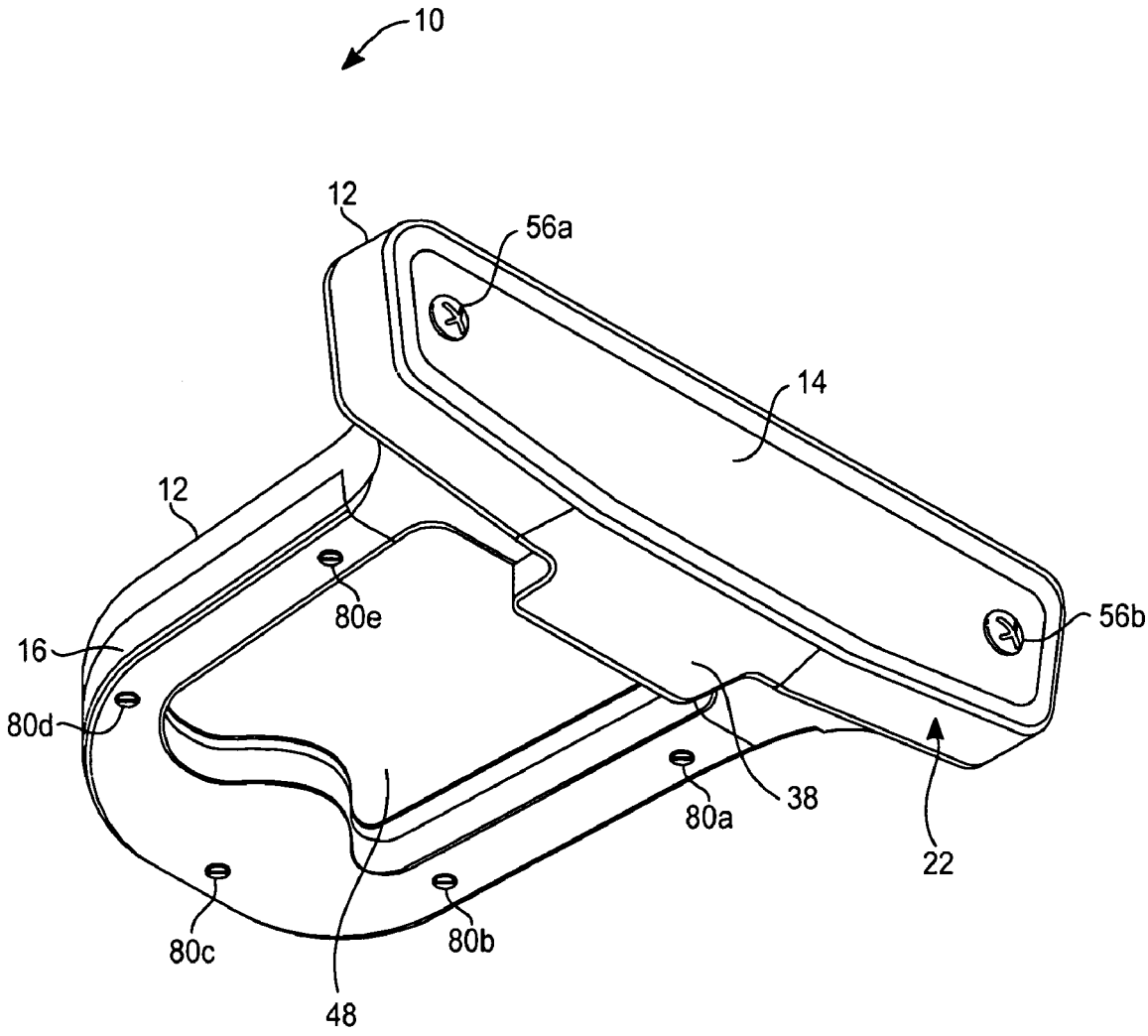
FIG. 1 is a perspective view of the putter head of the present invention.
Figure 2:
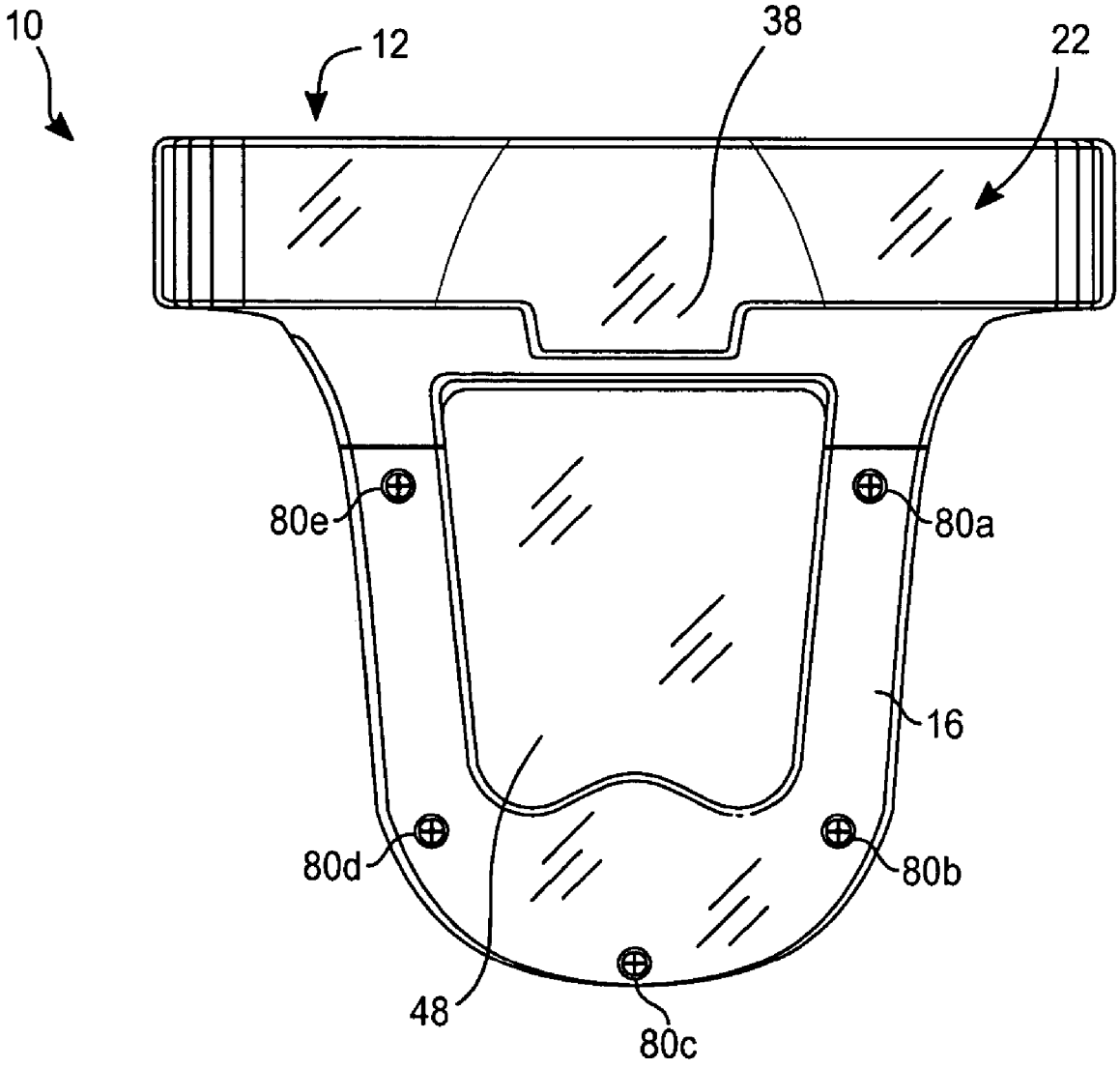
FIG. 2 is a bottom view of the putter head of FIG. 1.

With reference to FIGS. 1 and 2, a putter head 10 of the present invention is seen. A mallet style putter head is pictured, however, other putter heads, such as a blade style putter head, may be used to achieve the putter head of the present invention. The putter head features a main body frame 12, first weighting member 14, and second weighting member 16; the main body frame 12, the first weighting member 14, and the second weighting member 16 having various combinations of weights. The main body frame 12 forms a support structure for added weight portions. The putter head 10 is modular in design.

Various combinations of first and second weighting member weights and main body frame weights are used, as will be described below, to achieve a dynamically balanced putter. To achieve the various combinations of weights, the first weighting member 14, the second weighting member 16, and the main body frame 12 are comprised of materials having particular densities. In one example, each weighting member is comprised of a material having a density greater than the density of the main body frame. The first weighting member 14 and the second weighting member 16 may be comprised of the same material having the same density or of different materials having densities that differ from each other. The weighting members are comprised of, for example, one of brass, tungsten, stainless steel, and iron. The main body frame 12 is comprised of, for example, aluminum.

Figure 3:
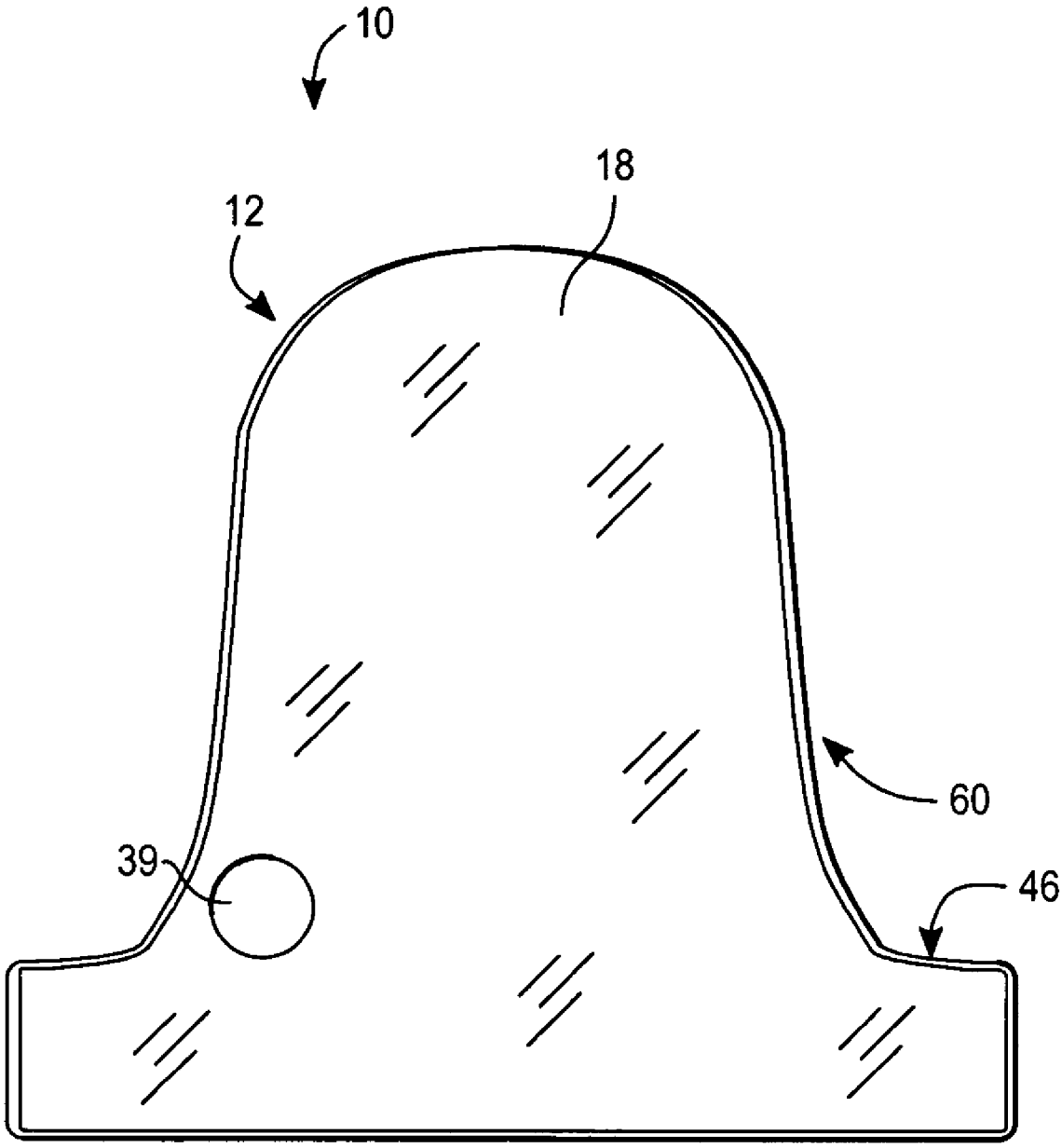
FIG. 3 is a top view of the putter head of FIG. 2.
Figure 7:
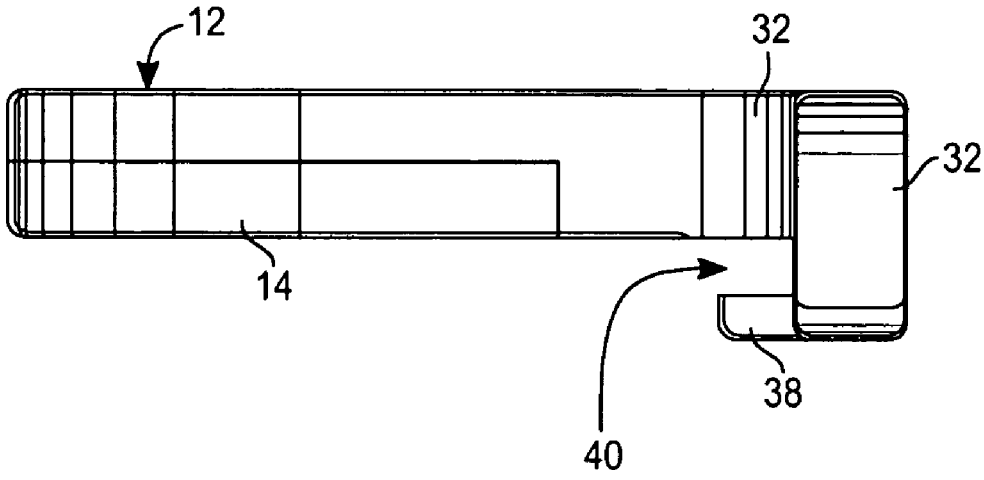
FIG. 7 is a right side view of the putter head of FIG. 1.
Figure 8:
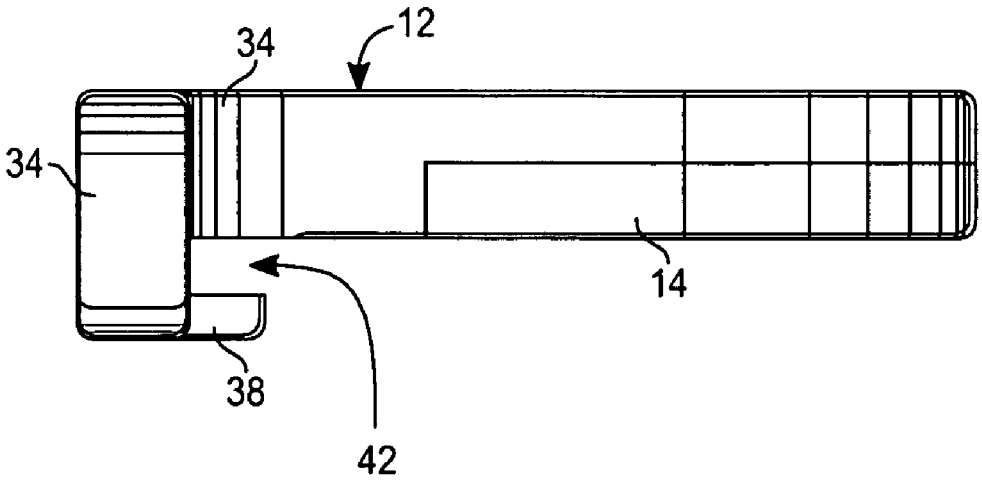
FIG. 8 is a left side view of the putter head of FIG. 1.

The main body frame includes a top surface 18 (FIG. 3), and underside of the top surface 20 (FIG. 4) disposed in an upper portion of the main body frame 12, a sole 22 opposed to the top surface, and a perimeter 24 defining side surfaces 26 and 28 and rear surface 30 (FIG. 6) of the main body frame 12, the side surfaces 26 and 28 including heel and toe ends 32 and 34 (FIGS. 7 and 8), respectively, and a front surface 36 (FIG. 4) disposed between the side surfaces 26 and 28. A hosel 39 (FIG. 3) is seen on the top surface. A putter shaft (not shown) is mounted within the hosel. In one example, the sole 22 (FIG. 4) includes a tongue 38 extending outwardly from the sole. The tongue, for example, has a length of 1 inch. The sole 22, for example, has a width substantially less than the width of the top surface 18. In one example, the sole 22 has a width that is approximately ⅙ of the width of the top surface. In one example, the heel end 34 and the toe end 36 are stepped, as seen in FIGS. 7 and 8. The stepped heel and toe ends form recesses 40 and 42.

Figure 4:
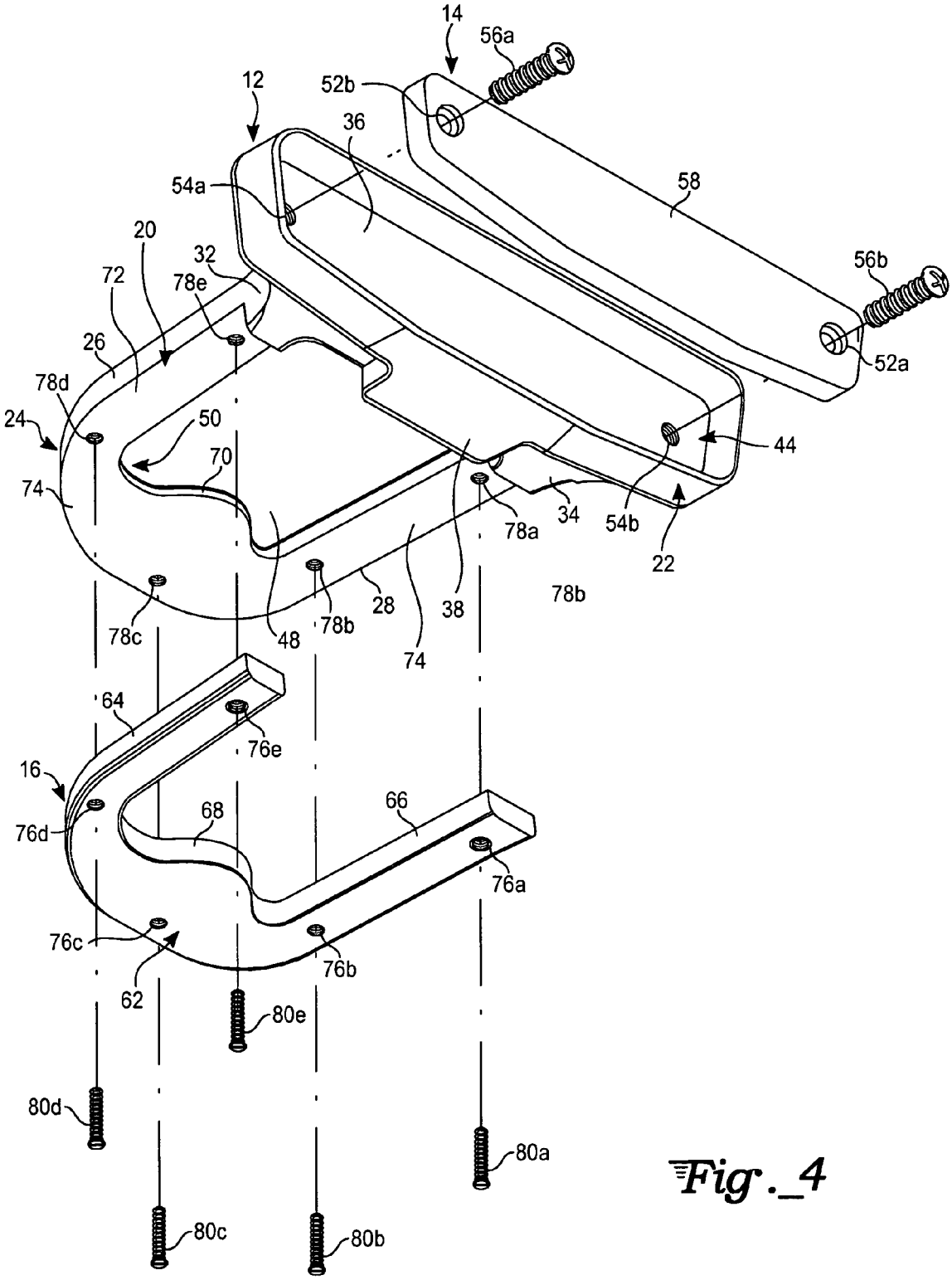
FIG. 4 is an exploded view of the putter head of FIG. 1.
Figure 5:
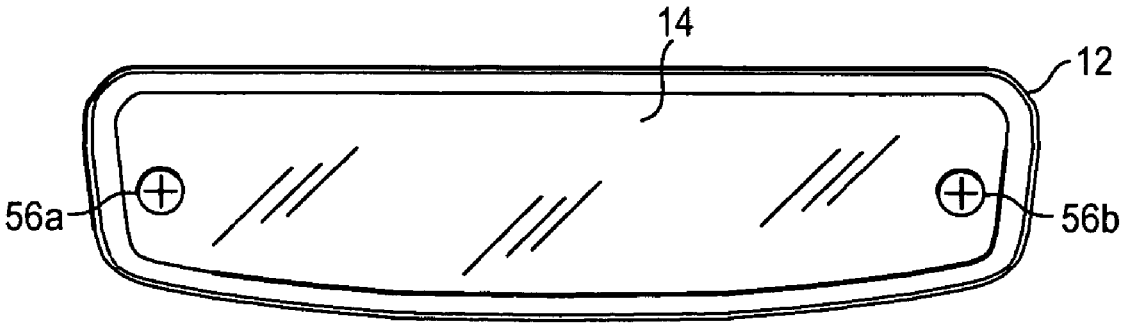
FIG. 5 is a front view of the putter head of FIG. 1.

The pictured main body frame 12 has a high center of gravity. In one example, the upper portion, within which the underside is disposed, is an upper half of the main body frame 12. The front surface 36 is, for example, disposed within a front recess 44 (FIG. 4). For instance, the upper portion is ½ the height of a front portion 46 (FIG. 3) of the main body frame 12 including the recess 44. The top surface 18 (FIG. 3) and the underside 20 (FIG. 4) extend outwardly to the perimeter surfaces 26 and 28 and rear surface 30. In one example, the underside 20 includes an underside surface 48 that is raised relative to underside surface 74, forming a recess 50.

Figure 6:
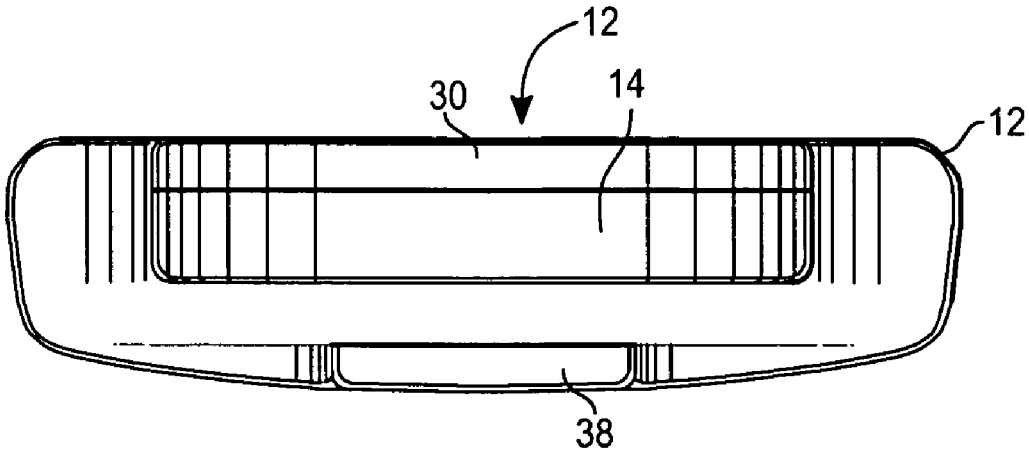
FIG. 6 is a rear view of the putter head of FIG. 1.

With reference to FIGS. 4 and 6, the first weighting member 14 is attached to the front surface 36. In the pictured example, the first weighting 14 includes a pair of openings 52*a* and 52*b*, and the front surface 36 includes a pair of threaded openings 54*a* and 54*b*. The first weighting member 14 is received within the recess 44 such that the openings 52 and 54 are in alignment. The first weighting member 14 is attached to the front surface 36 by, for example, a pair of screws 56*a* and 56*b* inserted within the openings 52*a* and 52*b*, respectively, and threaded within the openings 54*a* and 54*b*, respectively. The first weighting member 14 has a shape that is substantially the same as the shape of the recess. The first weighting member has a front surface 58, against which a golf ball (not shown) is struck. The front surface 58 may be substantially flat or may include a loft angle. The first weighting member 14 is customizable and may be interchangeable with other weighting members having, for example, various loft angles and/or more or less weight towards either end of the first weighting member.

Still referring to FIG. 4, the second weighting member 16 is attached to the underside 20 of a rear portion 60 (FIG. 3) of the main body frame 12 disposed behind the front portion 46 of the putter head 10. The second weighting member 16 includes a rear portion 62 and opposed side portions 64 and 66 that extend outwardly to the perimeter surfaces 24. The second weighting member 16 is of a shape equal to a shape of the underside 20 or a portion of the underside 20. In the pictured example, the second weighting member 16 is horseshoe shaped and includes a middle portion having a tortuous inner surface 68 that has a width greater than a width of the side portions 64 and 66. Conversely, in the pictured example, the underside 20 is horseshoe shaped and includes a middle portion having a tortuous inner surface 70 that has a width greater than side portions 72 and 74 of the horseshoe shaped underside. In the pictured example, the second weighting member 16 includes a plurality of openings 76*a–e* that align with a plurality of threaded openings 78*a–e* of the underside. The second weighting member 16 is attached to the underside 20 of the main body frame by, for example, a plurality of screws 80*a–e* inserted within the openings 76*a–e*, respectively, and threaded within the openings 78*a–e*, respectively. The second weighting member 16 is flush with respect to the side surfaces 26 and 28 and rear surface 30 of the main body 12.

In one embodiment of the present invention, the main body frame 12 of the putter head 10 of the present invention is formed by milling out portions of an already existing putter head and attaching the first and second weighting members to the frame, as described above. A front portion, including a front surface, such as surface 36 is milled out of the existing putter head. The first weighting member 14 is secured to the front surface of the milled out front portion. A portion beneath a top surface of the existing putter head, including an underside such as underside 20, is milled out in an upper portion of the main body frame. The second weighting member 16 is secured to an underside of the milled out upper portion beneath the top surface.

Various combinations of weights are used in the present invention to achieve a dynamically balanced putter head 10. It is desirable that any two of the group consisting of the main body frame 12, first weighting member 14, and second weighting member 16 have the same weight. In one example of the present invention, the first weighting member 14 and the second weighting member 16 have the same weight. For example, the main body frame 12 comprises a weight that is 20% of a weight of the putter head 10 and the first weighting member 14 and the second weighting member 16 each comprise a weight that is 40% of the putter head 10. In the above example, the main body frame 12 has a weight that is less than the weight of each of the first weighting member 14 and the second weighting member 16. However, the main body frame 12 may have a weight that is greater than the weight of each of the first weighting member 14 and the second weighting member 16.

In an additional example of the present invention, the first weighting member 14 and the main body frame 12 comprise the same weight. For example, the first weighting member 14 and the main body frame 12 each comprise a weight that is 30% of the weight of the putter head 10 and the second weighting member 16 comprises a weight that is 40% of the weight of the putter head. In the above example, the second weighting member 16 has a weight that is greater than the weight of each of the first weighting member 14 and the main body frame 12. In another example, the second weighting member 16 may have a weight that is less than the weight of each of the first weighting member 14 and the main body frame 12.

In another example, the main body frame 12 has a weight greater than each of the first weighting member 14 and the second weighting member 16. For example, where the golf putter head 10 has a total weight of 340 grams, the first weighting member 14 has a weight of 110 grams, the second weighting member 16 has a weight of 110 grams, and the main body frame 12 has a weight of 120 grams. In this example of the present invention, the first weighting member 14, the second weighting member 16 and the main body frame 12 are approximately equal in weight, i.e. they are each approximately ⅓ of the weight of the putter head 10.

What is claimed is:

1. A golf putter head comprising:

a main body frame having a top surface, an underside of the top surface, the underside disposed in an upper portion of the main body frame, a perimeter defining side and rear surfaces of the main body, and a front surface disposed between said side surfaces;

a first weighting member attached to said front surface of said main body frame; and a second weighting member attached to said underside, said second weighting member including a rear portion and opposed side portions extending outwardly to said perimeter surfaces.

2. The golf putter of claim 1 wherein any two of the group consisting of a main body frame weight, a first weighting member weight, and a second weighting member weight are the same weight.

3. The golf putter head of claim 1 wherein either said first weighting member and said second weighting member weigh the same or said first weighting member and said main body frame weigh the same.

4. The golf putter head of claim 1 wherein said first weighting member and said second weighting member are the same weight.

5. The golf putter head of claim 4 wherein said main body frame weighs less than each of said first weighting member and said second weighting member.

6. The golf putter head of claim 4 wherein said main body frame weighs greater than each of said first weighting member and said second weighting member.

7. The golf putter head of claim 4 wherein said main body frame has a weight that is 20% of a weight of the putter head, and said front striking member and said second weighting member each have a weight that is 40% of the weight of the putter head.

8. The golf putter head of claim 1 wherein said first weighting member and said main body frame are the same weight.

9. The golf putter head of claim 8 wherein said second weighting member has a weight greater than each of said first weighting member and said main body frame.

10. The golf putter head of claim 8 wherein said second weighting member has a weight that is 40% of a weight of the club head, and said first weighting member and said main body frame each have a weight that is 30% of the weight of the putter head.

11. The golf putter head of claim 8 wherein said second weighting member has a weight less than each of said first weighting member and said main body frame.

12. The golf putter head of claim 1 wherein said second weighting member, said first weighting member, and said main body frame are approximately equal in weight.

13. The golf putter head of claim 1 wherein said golf putter head has a total weight of 340 grams, said first weighting member having a weight of 110 grams, said second weighting member having a weight of 110 grams, and said main body frame having a weight of 120 grams.

14. The golf putter of claim 1 wherein the main body frame is comprised of a first material having a first density and the first weighting member and the second weighting member are each comprised of a material different from said first material.

15. The golf putter head of claim 14 wherein said different material has a density greater than the density of the first material.

16. The golf putter head of claim 14 wherein the first weighting member and the second weighting member are comprised of different materials.

17. The golf putter head of claim 14 wherein said first weighting member is comprised of a second material having a second density and said second weighting member is comprised of a third material having a third density.

18. The golf putter head of claim 14 wherein said first material is aluminum.

19. The golf putter head of claim 14 wherein said different material is selected from the group consisting of brass, tungsten, stainless steel, and iron.

20. The golf putter head of claim 1 wherein said underside is disposed within an upper half of said main body frame.

21. The golf putter head of claim 1 wherein said second weighting member is horseshoe shaped.

22. The golf putter head of claim 21 wherein said second weighting member includes a middle portion having a width greater than a width of the sides.

23. The golf putter head of claim 22 wherein said middle member includes a tortuous inner surface.

24. The golf putter head of claim 1 wherein said second weighting member includes a middle portion having a width greater than a width of the sides.

25. The golf putter head of claim 1 wherein said underside of said top surface includes a first surface raised relative to a second surface.

26. The golf putter head of claim 1 wherein said second weighting member is horseshoe shaped and said underside is horseshoe shaped.

27. The golf putter head of claim 1 wherein said second weighting member is of a shape that is the same as a shape of said underside.

28. The golf putter head of claim 1 wherein said second weighting member is disposed in said upper portion of said main body frame.

29. The golf club head of claim 1 wherein said second weighting member is flush with respect to said side and rear surfaces.

30. The golf putter head of claim 1 wherein said second weighting member and said first weighting member are attached by screws to said main body frame.

31. The golf putter head of claim 1 wherein said main body frame has a high center of gravity.

32. The golf putter head of claim 1 wherein said main body frame is mallet shaped.

33. The golf putter head of claim 1 wherein said side surfaces include heel and toe ends.

34. The gold putter head of claim 33 wherein said heel and toe regions are stepped.

35. The golf putter head of claim 33 wherein said heel and toe regions each intersect with said underside to form a recess.

36. The golf putter head of claim 1 further comprising a sole opposed to the top surface.

37. The golf putter head of claim 36 wherein said sole includes a tongue extending from said sole.

38. The golf putter head of claim 36 wherein said sole has a width substantially less than a width of the top surface.

39. The golf putter head of claim 1 wherein said first weighting member has a flat front surface.

40. The golf putter head of claim 1 wherein said front surface is disposed within a recess.

41. A golf putter head comprising:

a main body frame having a top surface, a pair of side surfaces, a rear surface, a milled out front portion including a front surface, and a milled out portion beneath said top surface including an underside disposed in an upper portion of said main body;

a first weighting member attached to said front surface; and a second weighting member having a rear portion and opposed side portions extending outwardly to said rear and side surfaces, respectively, said weighting member attached to said underside.

42. The golf putter head of claim 41 wherein the main body frame is comprised of a first material having a first density and the first weighting member and the second weighting member are comprised of a material different from said first material, said different material having a different density.

43. The golf putter head of claim 42 wherein said different density is greater than said first density.

44. The golf putter head of claim 41 wherein any two of the group consisting of a main body frame weight, a first weighting member weight, and a second weighting member weight are the same weight.

45. The golf putter head of claim 41 wherein either said first weighting member and said second weighting member weigh the same or said first weighting member and said main body frame weigh the same.

46. The golf putter head of claim 41 wherein the first weighting member and the second weighting member are the same weight.

47. The golf putter head of claim 41 wherein the first weighting member and the main body frame are the same weight.

48. The golf putter head of claim 41 further comprising a sole opposed to the top surface.

49. The golf putter head of claim 48 wherein said milled out portion beneath said top surface is between said sole and said top surface.

50. A golf putter head comprising:

a main body frame comprised of a first material having a first density, said main body having a top surface, an underside of said top surface, the underside disposed in an upper portion of the main body, a pair of side surfaces, a rear surface and a frontwardly facing surface disposed between the side surfaces;

a first weighting member supported by said main body frame and disposed adjacent to said front surface of said main body frame; and a second weighting member supported by said main body frame and disposed adjacent to said underside, said second weighting member including a rear portion and opposed side portions and extending outwardly to said rear and pair of side surfaces.

51. The golf putter head of claim 50 wherein the first weighting member and the second weighting member are comprised of a second material, said second material different from said first material and having a second density.

52. The golf putter head of claim 51 wherein said second density is greater than said first density.

53. The golf putter head of claim 52 wherein any two of the group consisting of a main body frame weight, a first weighting member weight, and second weighting member weight are the same weight.

54. The golf putter head of claim 52 wherein either said first weighting member and said second weighting member weigh the same or said first weighting member and said main body frame weigh the same.

55. The golf putter head of claim 52 wherein the first weighting member and the second weighting member are the same weight.

56. The golf putter head of claim 52 wherein the first weighting member and the main body frame are the same weight.

* * * * *